United States Patent [19]

Suga

[11] 4,144,697

[45] Mar. 20, 1979

[54] PACKING APPARATUS

[76] Inventor: Tadoru Suga, 1-6-44, Nakahozumi, Ibaragi, Osaka, Japan

[21] Appl. No.: 786,431

[22] Filed: Apr. 11, 1977

[51] Int. Cl.[2] ..... B65B 9/06

[52] U.S. Cl. ..... 53/556; 53/547; 53/206

[58] Field of Search ..... 53/180 R, 182 R, 184 R, 53/179, 201, 206, 209, 210, 66

[56] References Cited

U.S. PATENT DOCUMENTS

| | | | |
|---|---|---|---|
| Re. 28,535 | 9/1975 | Ganz | 53/210 X |
| 2,655,777 | 10/1953 | Hagen | 53/66 X |
| 3,007,295 | 11/1961 | Heinzer | 53/180 R |
| 3,473,288 | 10/1969 | Nakamura | 53/182 R X |
| 3,517,479 | 6/1970 | Pinkham | 53/180 R X |
| 3,532,516 | 10/1970 | Erekson | 53/180 R |
| 3,537,235 | 11/1970 | Pepmeier et al. | 53/210 X |
| 3,540,187 | 11/1970 | Monaghan | 53/209 X |
| 3,546,849 | 12/1970 | Zimmerman | 53/182 R X |
| 3,552,088 | 6/1971 | Niwa | 53/182 R |
| 3,650,089 | 3/1972 | Miller et al. | 53/180 R |
| 3,967,433 | 7/1976 | Bonfiglioli | 53/184 R |
| 3,973,372 | 8/1976 | Omori | 53/182 R |

*Primary Examiner*—John Sipos

*Attorney, Agent, or Firm*—George H. Mitchell, Jr.; Arnold B. Christen; Eugene Sabol

[57] ABSTRACT

Apparatus for wrapping articles in heat sealed thermoplastic stretchable film consists of a first conveyor for carrying an article forward while progressively enclosing it with film drawn from a film supply, joining the margins of the film together to enclose the article in an elongated tube of film, cutting the film so as to provide equal amounts of excess film at each end of the article, using a vacuum inlet to pull the trailing portion of film to one side of the article so that a transverse rod, moving faster than the article, can fold the trailing portion against one side of the article, folding the leading portion of film against the same side by means of a roller, and finally moving the article into contact with a heated belt to seal the film.

8 Claims, 17 Drawing Figures

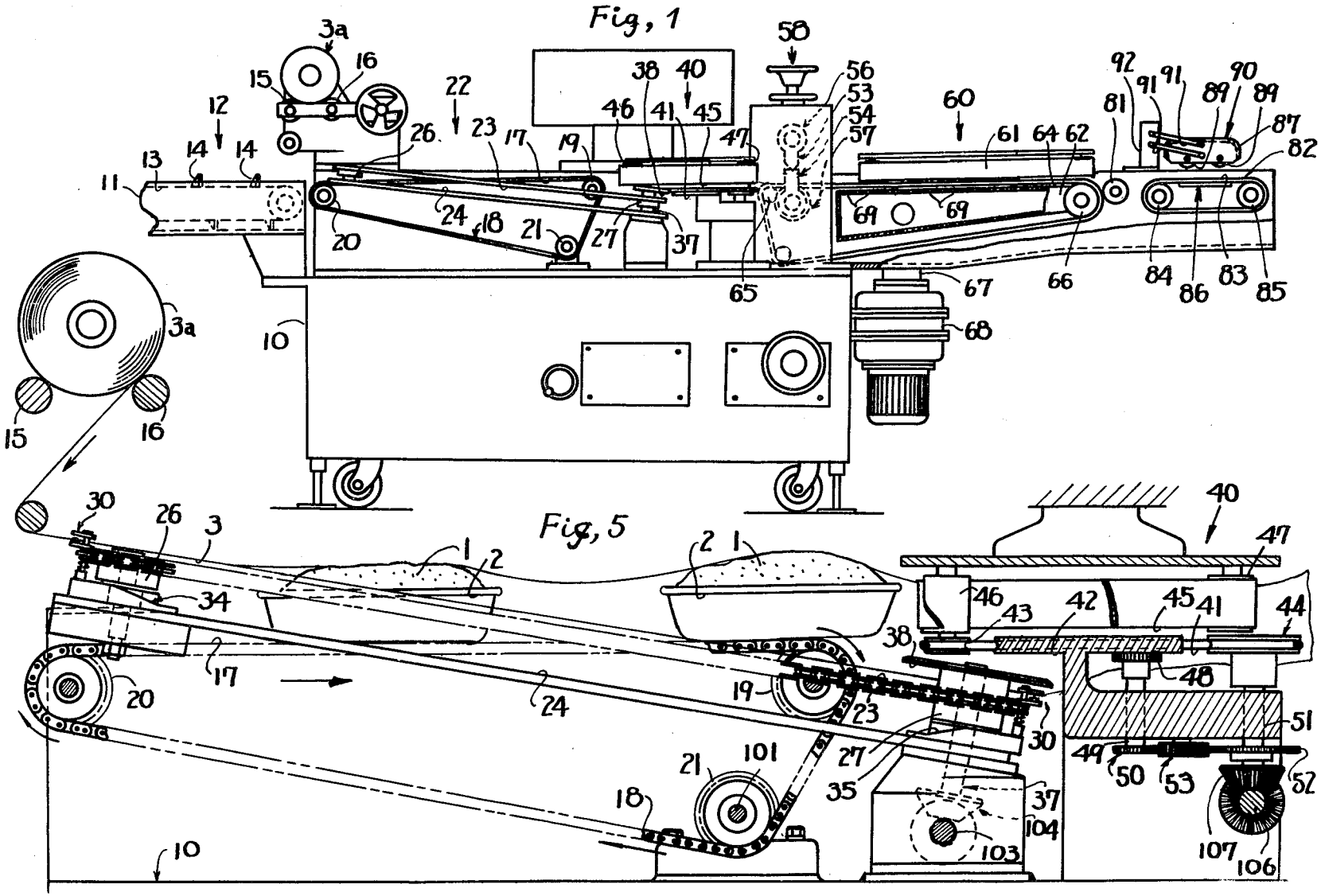
Fig, 1
Fig, 5

Fig, 4
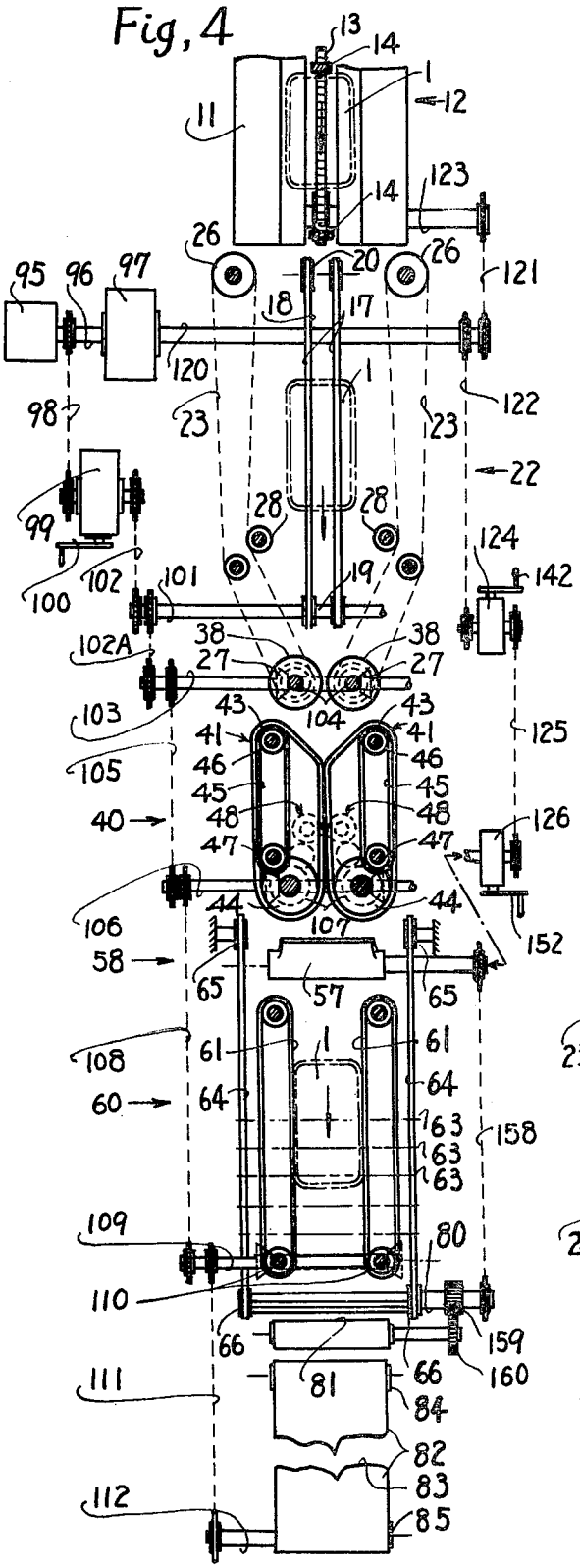
Fig, 8
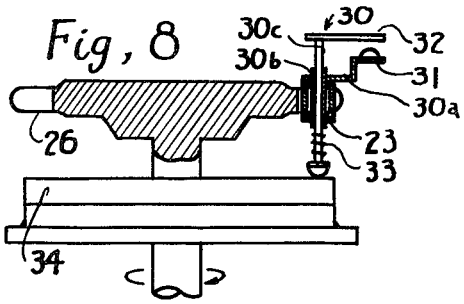
Fig, 7
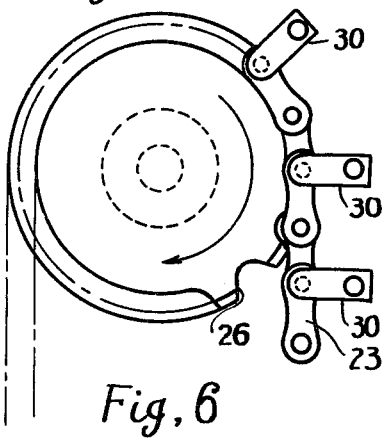
Fig, 6
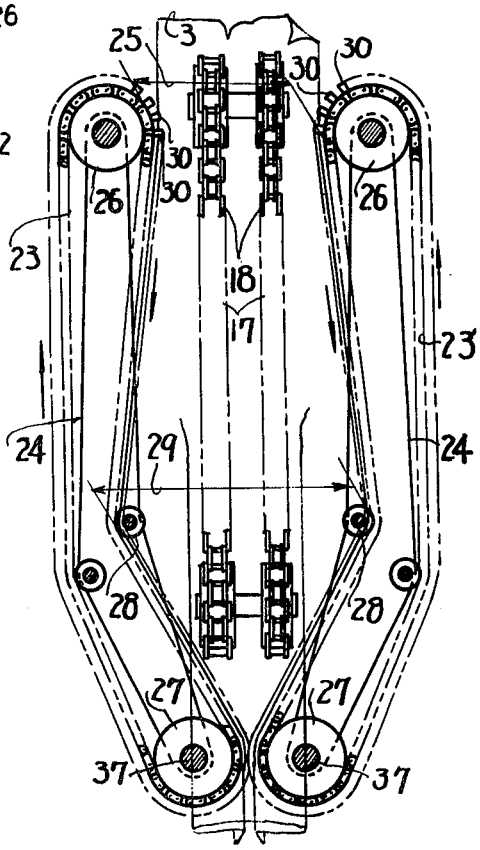

PACKING APPARATUS

The present invention relates to apparatus for packing articles in a film of synthetic resin such as polyvinyl chloride, butadiene rubber, or polyethylene and so forth. Films of this type are by nature rather soft and extensible. The present apparatus is designed to use films having the above-mentioned extensible nature which are also capable of resuming their original dimensions after being stretched. Therefore, apparatus according to this invention is capable of packaging articles with an extensible type of film, which film after being stretched will resume its original shape to tightly enclose the article after being wrapped. One object of the present invention is to provide means for efficiently stretching a band of extensible film while covering an article to be packaged.

Another object of the present invention is to provide means for cutting the correct length of film from a roll of the film to correspond to the size of the article being packaged so as to allow a certain amount of film to overlap at both ends of the package and also to provide means for pulling down the extending ends of the film by air pressure, including the utilization of movement of the package and a velocity difference for turning the ends of the film to lie against the bottom surface of the package which also includes means for preventing the stripping of the ends of the film from the bottom surface after the packaging is completed.

Still another object of the present invention is to provide means for easily adjusting the length of the film to be cut from the supply roll in proportion to the length of the packages to be wrapped so that for each package there will be provided the proper length for turning the end portions of the film underneath the package and against the bottom surface, and means for momentarily matching the velocity of the film being conveyed with the velocity of the cutting means.

The present invention comprises a number of cooperating mechanisms as set forth hereinafter. First there is a mechanism which includes means for conveying packages at a uniform speed with respect to the supply of film. A second mechanism includes means for continuously covering packages in sequence with a length of film moving in the same direction as the packages and for stretching the film over the packages in a barrel-shaped form. A third mechanism includes means for cutting the ends of the barrel-shaped film at both ends of the packages. The fourth mechanism includes means for folding the film ends down by air pressure, while a fifth mechanism includes means for depositing both ends of the turned down film on the bottom surface of the package.

Other objects and advantages will be apparent to those skilled in the art after reading the following specification and claims in connection with the attached drawings, in which:

FIG. 1 is a side elevation of a preferred form of packaging mechanism according to the present invention;

FIG. 4 is a schematic plan view showing the relationship between each mechanism and a power unit;

FIG. 5 is a side view, partly in section, showing the initial wrapping portions;

FIG. 6 is a plan view showing a portion of the mechanism of FIG. 5;

FIG. 7 is an enlarged fragmentary view of a chain wheel of FIG. 6;

FIG. 8 is a vertical view, partly in section of FIG. 7;

Figures 2, 3, 9:
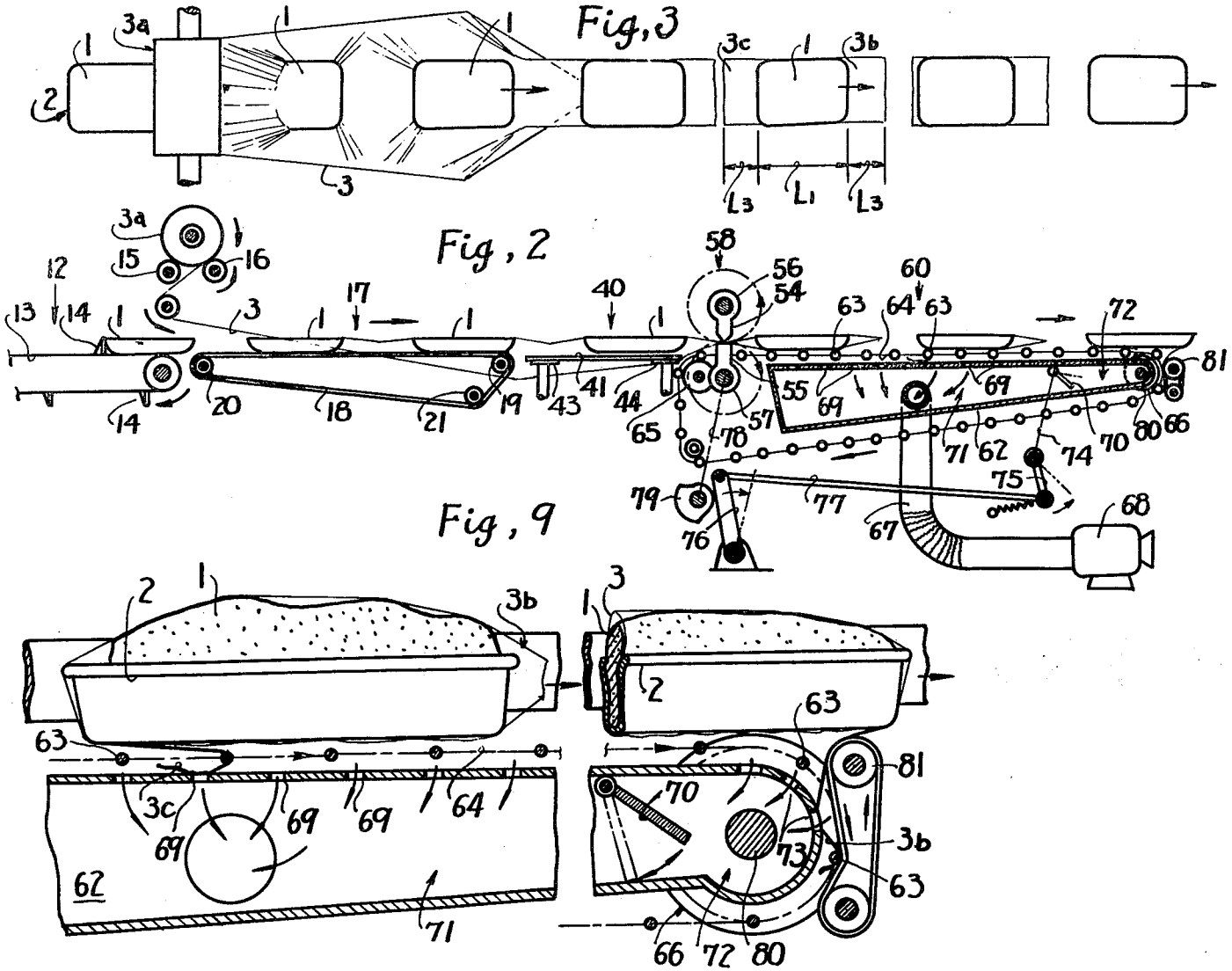
FIG. 2 is a side elevation, partly in cross-section of part of the invention shown in FIG. 1.
FIG. 3 is a diagrammatic plan view showing the relationship between a package and a film.
Figures 10, 11, 12, 13, 14, 15, 16, 17:
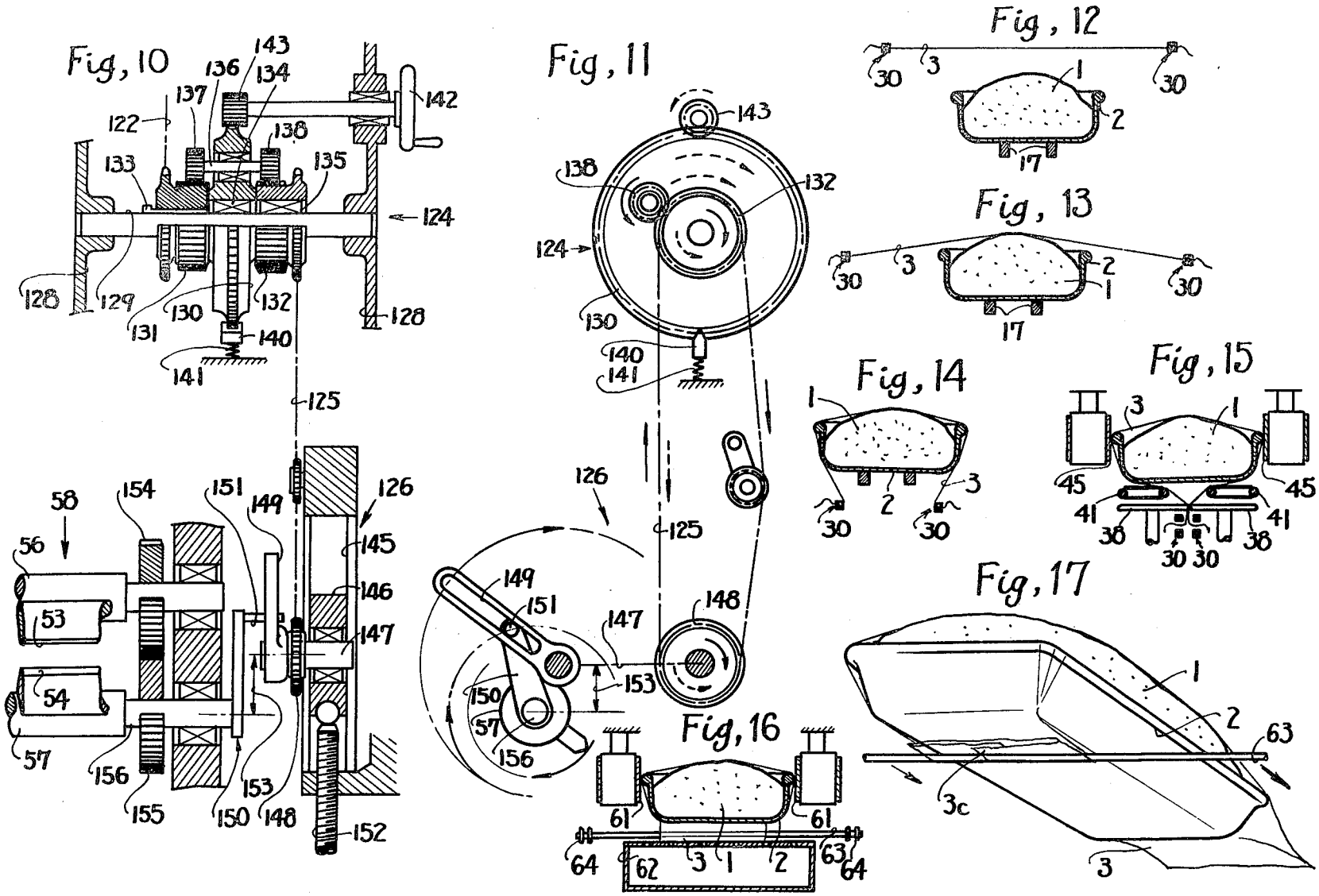

FIGS. 9 through 11 disclose various details of the mechanism, and;

FIGS. 12 through 17 show successive steps in the application of the wrapping material.

As shown in the drawings, the numeral 1 designates a package, such as a food product, or a manufactured article, contained in a pan, or plate, to be wrapped.

As shown in FIG. 1, wrapping apparatus is composed of a cabinet 10 to support a number of mechanisms installed on the stand. The frame 11, horizontally connected with the left side of the stand 10 is for a conveyor which supplies the packages to be wrapped with film. This supply conveyor 12 has a chain 13 continuously moving along the frame 11 to convey the packages which slide on the upper surface of the frame 11 as a result of being pushed by the fingers 14 formed at uniform distances along the chain 13.

A pair of rollers 15 and 16 are mounted on the upper part of the stand 10 and parallel with each other. As shown in FIG. 2 and FIG. 5, a roll of film 3*a* is supported on the upper surfaces of the rollers 15 and 16. These rollers 15 and 16 are allowed to rotate freely, but a damping force is applied to at least one roller, such as roller 15, so that as the film unrolls from the supply roller 3*a*, it is prevented from becoming loose. While the drawings show that the film 3 is transparent, it obviously may be translucent or opague and may be imprinted. A second conveyor 17 is provided on the upper part of stand 10 below the rollers 15 and 16 which support the film 3. This conveyor 17 is positioned in alignment with the conveyor 12 and comprises an endless chain 18 supported on the stand 10 by the rollers 19, 20 and 21.

Further, a film guiding mechanism 22 for stretching and carrying the film around the packages in a barrel-shaped form is provided along the conveyor 17, and is shown in FIGS. 4 through 8 in more detail.

As shown in FIG. 6, a pair of endless chains 23 are provided on both sides of conveyor 17 and supported by respective multiple chain wheels 26, 27 and 28 which are mounted on a pair of base plates 24. Also, a number of clips 30 are mounted on the chain 23 at uniform distances from each other.

The distance between the chain wheels 26, indicated by the arrow 25 in FIG. 6 at the incoming end of the chains 23 is equal to the width of the band of film 3 while at an intermediate position further along at the chain wheels 28 the distance between the chains, indicated by the arrow 29, is larger than the distance indicated by the arrow 25. Further, at the outgoing end of the chains 23 the chain wheels 27 are close to each other which also brings the two chains close to each other at their outgoing ends. As shown in FIG. 8 each of the clips 30 is provided with a projection 31 formed as an extension of one of the links 30*a* of the chain 23. A rod 30*c* is slidably inserted within a hollow chain pin 30*b* and a projecting finger 32 attached to the upper end of the rod 30*c* is positioned above the projection 31. A coil spring 33 mounted on the rod 30*c* urges the finger 32 into engagement with the projection 31.

As shown in FIGS. 1, 5 and 6, a pair of base plates 24 are positioned on both sides of conveyor 17 in a forwardly and downwardly inclined plane in the direction of movement of conveyor 17 and the chains 23 are arranged to be disposed in parallel with these base plates 24. Also, beneath each of the chain wheels 26 and each of the chain wheels 27 the cams 34 are fixed on the bases 24. These cams engage with the lower ends of the rods 30c. In addition the vertical shafts 37, which support the chain wheels 27, also support at their upper end a pair of throttle rollers 38.

As a continuation of the covering mechanism, indicated generally by numeral 22, there is a sealing end shrinking mechanism, indicated generally by numeral 40. As shown in FIG. 4 this mechanism includes a pair of endless belts 41 which are actuated in synchronism. As shown in FIG. 5 the loops formed by the belts 41 are supported by pulleys 43 and 44 and are guided for most of their travel in a pair of guide grooves formed in the margins of the guide plates 42. The pulleys 43 are mounted on the same shaft as the rotors 46 which support the entrance end of a pair of endless flat belts 45, the output ends of the belts being supported on the cylindrical rotors 47 above the pulleys 44. A portion of the guide 42 are mounted just above the throttle rollers 38 and a pair of heating rollers 48 are provided below the surface of the guide 42. An electric heater is provide within each of the heating rollers, and a gear 50, fixed on the lower end of the shaft 49, which supports the heating rollers, is connected with a gear 52. The gear 52, is mounted at the lower end of a driving shaft 51 which drives the pulleys 44, so that the heating rollers 48 are rotated in synchronism with the pulleys 44.

As can be seen in FIGS. 1 and 2, following the mechanism 40 for sealing and shrinking the film, there is a mechanism for cutting off the film, indicated by numeral 58. This mechanism consists of upper and lower rotary elements 56 and 57, the upper element 56 including an axially extending knife 54, while the lower element 57 includes an axially extending plate 55 which serves as an anvil for the knife 54 so that when the knife and anvil are rotated so as to be in engagement with each other the film 3 will be severed.

Further on, beyond the cutting mechanism is a folding mechanism, indicated by numeral 60, for folding the cut ends of the film down around the lower surface of each of the packages 1. As shown in FIG. 4 the mechanism 60 includes a pair of endless belts 61 which convey the packages by contact with both sides thereof. Positioned below the belts, as can be seen in FIG. 9, as well as FIG. 4, are a pair of endless chains 64 carrying a number of transversally disposed rods 63 and below these rods is an elongated housing 62. One end of the chains 64 are supported by the wheels 65 while the further ends are supported by the wheels 66. The trailing ends of the cut film are engaged by the transverse rods 63 which move faster than the belts 61 so as to carry the film underneath the packages.

As shown in FIG. 2, the housing 62 is contained within a loop defined by the chains 64 and the interior of the housing is connected with a vacuum pump 68 by means of a duct 67. The housing 62 is provided with a flat upper surface having a series of air inlet holes 69 formed therein. As shown in FIG. 9 the housing 62 is subdivided into a large compartment 71 at the end which is first encountered by the moving packages, and a small compartment 72 at the further end by means of a flap valve 70 provided within the housing. The small compartment 72 is generally cylindrical in outline and a number of air inlet holes 73 are formed on the exterior cylindrical surface and the rods 63 are carried around this compartment in a concentric path by means of the chains 64. As shown in FIG. 2, a shaft 74 which supports the flap valve 70, projects outside of the housing 62 and a bell crank lever 75 is attached at one end of this shaft for connection with a lever 76 by means of a connecting link 77. The lever 76 is urged into contact with the circumference of a rotating cam 79 which is fixed on shaft 78 which also supports the rotating element 53 forming the lower half of the cutting mechanism 58. The shaft 80, which supports the chain wheels 66, is rotatably supported concentrically with the exterior of the small compartment 72, while a parallel roller 81 which carries an endless belt engaging with the rods 63 is positioned just outside the small compartment 72.

As shown in FIG. 1, beyond the roller 81 there is a final conveyor 82 which comprises an endless belt 83 of refractory material carried by a pair of pulleys 84 and 85. An electric heater 86 is provided within the loop of the belt 83 and a weighting roll 87 is provided above the conveyor 82 so as to increase the adhesion between the underside of the film covering a package and the upper surface of the heated section of the belt 83. The weighting roll 87 includes a pair of rollers 89 which are supported on a frame 90. The frame 90 is supported for vertical reciprocatory movement by means of a pair of parallel arms 91 which are pivotally connected with a column 92. The rollers 89 are preferably formed from a flexible material such as urethane foam, so as to easily conform to the shape of the packages passing underneath.

All movements of the packaging machine and each of the mechanisms are regulated for desired cooperative operation by controlling mechanisms connected with the power supply as shown in FIG. 4 and as can be seen, an electric motor 95, which is connected to a power source not shown, drives two power transmitting systems one of which systems conveys the packaging film, while the other transmitting system conveys the packages.

The output shaft of the motor 95 is connected with a reduction gear 97 and also by means of the chain 98 to a variable speed gear 99 which controls the speed of travel of the film. The output speed of the gear 99 is controlled by means of a handle 100 and the output of the variable speed gear is connected to a shaft 101 by means of the chain 102 so as to drive the conveyor 17 through the wheels 19 fixed to the shaft 101. The shaft 101 is also connected by means of a chain 102A to a shaft 103 and the shaft 103 is connected with the two shafts 37 by means of bevel gear 104, as shown in FIG. 5. Accordingly, the speed of movement of the chains 23 is in agreement with the speed of the conveyor 17. Further, the shaft 103 is connected by means of a chain 105 with the shaft 106 which, in turn is connected with the pulleys 44 through the bevel gear 107, as shown in FIG. 5, so that the speed of the belts 44 also corresponds to the speed of the other conveyors as well as the flat belts 45 and the heaters 48. Further, shaft 106 is connected by a chain 108 with a shaft 109 which is connected to drive the belts 61 through the bevel gears 110 so that these belts also move at the correct speed. Finally, the shaft 109 is connected by the chain 111 with the shaft 112 on which is mounted the roller 85 for driving the heating conveyor 82.

The output shaft 120 of the reduction gear 97 drives two endless chains 121 and 122. The chain 121 drives a shaft 123 which operates the supply conveyor 12 so that the speed of the supply conveyor depends upon the ratio of the gear 97. The other chain, 122, drives a variable differential gear 124 which, in turn is connected by a chain 125 to drive a variable non-uniform speed change gear 126. The differential gear 124 and the non-uniform speed change gear 126 are shown in detail in FIGS. 10 and 11. A planetary gear train comprises gear 130 and two gears 131 and 132 are supported on a shaft 129 which is rotatably supported in a frame 128 in the differential gear housing 124. In this case the gear 131 is fixed to the shaft 129 by means of a key 133 while the gear 130 and the output gear 132 are rotatably supported on shaft 129 by means of the bearings 134 and 135. The planet gears 137 and 138 are fixedly secured at opposite ends of a shaft 136 which is rotatably supported eccentrically on the gear 130 and are respectively in engagement with the gears 131 and 132. In addition a detent device 140 engages with the gear 130. The detent device 140 is urged by means of the spring 141 into engagement with the gear teeth so as to prevent idle rotation of the gear 130. A pinion gear 143 is mounted at the end of the shaft for the handle 142 mounted in the frame 128 so as to engage with the teeth of the gear 130. Accordingly, since the rotation of the gear 130 is controlled by the handle 142 and fixed in position by the detent 140, when the input gear 131 is rotated by the input chain 122, the rotation of the input gear is transmitted to the output gear 132 through the planet gears 137 and 138. Thus, the angular position of the output gear with respect to the angular position of the input gear will be controlled by the positioning of the epicyclic gear 130.

In FIG. 11 if the planet gear 138, supported by the gear 130, is rotated in a counter-clockwise direction the output gear 132 will be rotated in a clockwise direction as shown by the solid line arrows. However, the angular position of the gear 130 can be changed by rotation of the handle 142 (FIG. 4) to rotate gear 143. Rotation of the gear 130 must necessarily change the position of the planet gear 138 and if the gear 130 is rotated in a clockwise direction the shifting of the gear 138 momentarily reduces its rotation and this consequently reduces the speed of the output chain 125. On the other hand, if the pinion gear 143 is rotated in a clockwise direction, the position of the gear 138 is shifted in a counter-clockwise direction which momentarily results in an increase in the speed of the chain 125.

Output chain 125 drives the non-uniform speed change gear, indicated generally by numeral 126 in FIG. 10, and this gear is supported on shaft 147, mounted in a bearing 146 which is displaceable in a guide 146. The shaft 147 is driven by the chain 125 through the gear 148, attached to the shaft. A laterally projecting driving arm 149 fixed at one end of the shaft 147 engages with an arm 150 which projects laterally from a shaft 156 of the rotary element 57 of the cutting mechanism 58. This driving motion is transmitted by means of the pin 151 on the arm 150 which slides in a slot provided in arm 149. The position of the bearing 146 can be adjusted along the length of the guide 145 by rotation of the threaded element 152. Thus the degree of eccentricity, indicated by the arrow 153 FIG. 11, between the shafts 147 and 156 can thus be controlled. While the driving arm 149 is driven by the chain 125 at a constant speed, the arm 150 is thereby rotated at a non-uniform speed because of the eccentric relationship between the shaft 147 and 156 and the degree of non-uniformity is increased in proportion to the increase in the amount of eccentricity. As can be seen in FIG. 10, the rotary elements 56 and 57 are connected with each other through gears 154 and 155 and the arrangement is such that at the angular position when the knife 54 contacts the anvil 53, the mechanism is rotating at its slowest speed.

As shown in FIG. 4, the element 57 of the cutting mechanism 58 is connected with the driving shaft 80 by means of the chain 158 and the shaft 80 drives the chains 64 and also drives the roller 81 through the gears 159 and 160.

The operation of the packaging mechanism operates as follows.

As can be seen in FIGS. 5 and 8 the clips 30 which are attached to the endless chain 23 are opened at the inlet end of the covering mechanism 22 because the cam 34 engages the rod **30*c* to push the finger 32 out of engagement with the projection 31. As soon as the clip 30 moves away from the inlet end the finger drops down on the projection 31 to grip the edge of the film and as it moves toward the outlet end the film is partially stretched in covering the package and forming the barrel-shape as can be seen in FIG. 6 and FIG. 3**.

As can be seen in FIG. 2 the packages 1, contained in the plates 2 are carried by a supply conveyor 12 to the next conveyor 17 which latter conveyor carries the packages beneath the film 3. Since the speed of conveyor 17 is the same as that of the film because they are both driven by the same power transmitting system, when the package first contacts the film 3 no slippage will occur between the article and the film. In FIG. 5 it is shown that the chains 23 are inclined so that the output end is at a lower level than the supporting surface of the chains 18 of conveyor 17. Thus, as can be seen from FIGS. 12 and 13 while the film is extended and stretched prior to contact with the packages, depending upon their heights, the margins are also moved downwardly. After the chains 23 have moved beyond the guide wheels 28 (FIG. 6) they move inwardly again toward each other so as to bring the margins of the film toward each other in a barrel-shape as shown in FIG. 14. From that point the package is conveyed to the mechanism 40 (FIG. 2) where the film is urged inwardly by the flat belts 45 as shown in FIG. 15. Finally, the two margins of the film are pinched between the throttle rollers 38 as well as the belts 41 mounted above the throttle rollers. In addition the diameter of the surrounding film 3 is further shrunken by operation of the heating rolls 48. However before the package enters the mechanism 40 the clips 30 are opened by operation of the cam 35 at the output end of the chains 23 as shown in FIG. 5.

After the shrinking operation takes place the package goes to the cutting mechanism 58 where the film is cut between each of the packages by means of the knife 54 and anvil 55.

As can be seen in FIG. 3 the length of each piece of film cut off must bear a specific relationship to the length, L1 of the package with an additional amount of film **3*b* and 3*c* extending out ahead of the package and trailing behind the package a distance in each case indicated by L3 regardless of the length L1 of the package itself. As shown in FIG. 4, while the speed of the packages covered with the film is proportional to the output speed of the speed changing gear 99, the rotary element 57 of the cutting mechanism 58 is rotated by a different power transmitting system than that which conveys the film. With respect to the supply conveyor 12, it will be realized that since the space between each of the pushers 14 on this conveyor is fixed it is evident that when a package having a long length is being conveyed the space between each package will necessarily become narrower. On the contrary in the case of packages which are comparatively shorter in length, a large space exists between each package on the supply conveyor 12. Thus in the case of a package of comparatively long size it is desirable to set the speed of the film conveying and the secondary conveyor 17 to move at a faster speed than that of the supply conveyor. At the same time by increasing the speed of the conveyor 17 the space between each package will also be increased and, on the other hand where the packages are of short length a decrease in the speed of conveyor 17 will reduce the space between each of the packages. The speed of the conveyor 17 and the feeding of the film can be controlled by rotation of the handle 100 on the speed changing gear 99 so that the length L3 of the leading and trailing ends of the film can always be controlled with respect to the length L1 of the package itself, as shown in FIG. 3**.

However, in the preceding adjustments only the film conveying speed and the speed of the conveyor 17 has been adjusted without regulating the speed of the rotary elements 56 and 57 of the cutting mechanism 58. As already indicated, in connection with FIGS. 10 and 11, adjustment of the threaded element 152 causes a change in the non-uniform speed of rotation of the two elements 56 and 57 so that as the eccentricity of the shaft 147 is increased with the respect to the shaft 156, there will be an increase in the maximum speed of the rotary elements as they move away from the point at which the knife 53 engages the anvil 54 and as the eccentricity, indicated at 153 in FIG. 11, approaches zero, the speed of the rotary elements approaches a uniform speed of rotation. Accordingly, the cutting speed of the knife can be coordinated with the movement of the film.

When the film is cut it is essential that it be at the proper positions along its length so that the packages are arranged at the center of each length of film cut so that the leading and trailing portions **3*b* and 3*c* (FIG. 3**) are approximately equal, otherwise there will be difficulty with the mechanisms which follow.

Therefore, means are provided for adjusting the operation of the cutting mechanism 58 with respect to the feeding of the film 3 so as to ensure that each package will be disposed approximately in the center of each length of film cut off, which adjustment can be made while the packaging machine is running. This adjustment can be made by rotation of the handle 142 which, by changing the position of the gear 130 changes the angular location of the planet gears 137 and 138. The result is, as previously explained, to momentarily increase or decrease the speed of the driving chain 125 for the cutting mechanism and, depending upon whether the planet gears are shifted in a clockwise or counterclockwise direction, the result is to shift the place at which the cutter 58 severs the film and makes it possible to provide for an equal amount of film at each end of the packages.

As previously described, after the package with the film which has been cut by the cutting mechanism 58 it moves to the folding mechanism 60 just beyond the cutting mechanism where the package is inwardly pinched between the pair of flat belts 61 and moved along by these belts over the top of the housing 62. While over the housing, the influence of the vacuum within the housing exerted through the openings 69 in the top of the housing tends to draw down the ends of the tube of film 3 which encircles a package. On the other hand, the rods 63, carried by the endless chains 64 move in the same direction as the package but at a higher speed than the movement of the belts 61 so that the trailing edge **3*c* of the film is engaged by one of the rods 63 and, as shown in FIGS. 16 and 17, folded up onto the underside of the plate 2** carrying the package.

The end of the tube of film **3*b* projecting from the leading end of the package 1 is pulled between one of the rods 63 and the roller 81 by the air entering the housing 62 through the air inlet openings 73 at the right-hand side of the housing as viewed in FIG. 9. As a result of the forward movement induced by the belts 61 the end 3*b* is folded under the bottom surface of the plate 2 as it is drawn away from the rod 63 and the roller 81**. Thus, the film is laid horizontally against the bottom of the package.

As can be seen in FIG. 2, the flap valve 70 opens, or closes, communication between the space 72 within the right-hand end of the housing 62 and the source of vacuum created by the pump 68 under the influence of the operation of the cutting mechanism 58. As shown in FIG. 9 the flap valve 70 is operated in synchronism with the cutting mechanism to cut off the vacuum at the right-hand end of the housing when the trailing end of the film **3*c* passes over that end of the housing so as to prevent that end of the film from being pulled away from the bottom of the package. The arrangement of the cam 79 is such that the timing of the valve 70** is adjusted to correspond to the length of the packages being wrapped.

The final stage of operation is when the package moves toward the heating conveyor 90 as shown in FIG. 1 where it can be seen that the heater 86 positioned under the heat resistant belt 63 seals the loose ends of the film to the bottom of the tube of film enclosing the main portion of the package. To assist in this operation the package is pushed down on the belt 83 by the weight of the rollers 87 to increase the sealing effect of the heater 86.

Although one form of the invention has been described and shown in this application it will be apparent that various changes and improvements may be made in the arrangement of parts which would come within the scope of the following claims.

What is claimed is:

1. Packaging apparatus for continuously enclosing successive articles within a covering of flexible stretchable thermoplastic film comprising:

a. conveyor means to move successive articles in a straight path;

b. a pair of endless chain means, each chain means including a plurality of fingers for successively gripping opposite margins of said film and for successively releasing said margins after enclosing an article on said conveyor with a predetermined length of said film;

c. said endless chain means be supported on respective opposite sides of said conveyor means for movement of said fingers with said articles and for movement of said fingers 1. initially in transversely divergent paths relative to each other to initiate stretching of the film prior to contact with the article;

2. to continue to move the margins in respective paths which are divergent to each other and convergent to said straight path of the articles to continue stretching of the film and to produce contact between the film and a progressively increasing area of the surface of an article;

3. to thereafter continue to move said margins in respective paths convergent to each other and divergent to said straight path to produce progressively increasing enclosing contact between the film and the surface of the article, and;

4. finally to move the respective opposite margins into contact with each other to complete the enclosing of said article;

d. sealing mechanism including means engaging opposite sides of a film covered article and a pair of opposing endless belts including heating means for sealing the opposite margins of the film together under the article to complete enclosing the article in a tubular envelope of film;

e. cutting means for severing the tubular film at locations between successive articles to provide leading and trailing tubular end portions for each article;

f. means for folding under said leading and trailing end portions comprising means for engaging opposite sides of an article to convey the article in a path away from said cutter, and;

g. means for applying heat and pressure to an area of the under side of an article to seal said end portions in place.

2. The invention defined in claim 1, wherein said apparatus includes means for adjusting the positions at which the cutting means severs the tubular film to equalize the respective lengths of said leading and trailing portions of film.

3. The invention defined in claim 1, wherein said apparatus includes a supply conveyor, and power transmitting means common to said supply conveyor, said conveyor means, said endless chain means, said cutting means and said means for folding under the leading and trailing portions of film, said power transmitting means including means to regulate the relative speed of said supply conveyor, said conveyor means, said endless chain means and said cutting means in order to adjust the length of film covering each article delivered by the supply conveyor.

4. The invention defined in claim 3, wherein said power transmitting means includes planetary gear means for transmitting power to said cutter means including planet gear means for transmitting power to an output gear connected to drive said cutter means, and means for shifting the angular position of the rotary axis of the planet gear means for adjusting the location at which the cutter means severs said film.

5. In package closing apparatus of the type defined in claim 1 wherein an article deposited in a pan having upstanding side walls has been enclosed in a tubular film of plastic material with leading and trailing portions of said tubular film extending beyond opposite ends of said article, said article side engaging means includes a pair of endless belt means for engaging opposite side walls of the pan enclosed in said tubular film to move the article a predetermined distance in one direction parallel with the axis of said tube, a series of inlets in communication with a vacuum source disposed for successive proximity to a horizontal surface of said enclosed pan during said movement for urging said trailing portion of said film toward said series of inlets, a series of rods disposed transverse to the direction of movement of said enclosed pan, means for moving said rods between said inlets and said horizontal surface of the enclosed pan in the same direction but at a faster rate of speed than said article to fold said trailing portion of film against said horizontal surface of the enclosed pan, and means for discontinuing the influence of an inlet at the end of said predetermined distance to prevent the folded portion of film from being unfolded.

6. The invention defined in claim 5, wherein said means for moving said rods includes a pair of spaced endless chain means.

7. The invention defined in claim 5, wherein said vacuum source includes an elongated housing in communication with a vacuum pump, said inlets comprising spaced openings provided in a wall of said housing.

8. The invention defined in claim 7, wherein said means for discontinuing the influence of an inlet comprises movable flap valve means for closing off one end of said housing from said vacuum pump.

* * * * *